US008714705B2

(12) United States Patent
Hasegawa

(10) Patent No.: US 8,714,705 B2
(45) Date of Patent: May 6, 2014

(54) LIQUID EJECTION HEAD

(71) Applicant: Canon Kabushiki Kaisha, Tokyo (JP)

(72) Inventor: Mitsutoshi Hasegawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/687,205

(22) Filed: Nov. 28, 2012

(65) Prior Publication Data

US 2013/0162716 A1 Jun. 27, 2013

(30) Foreign Application Priority Data

Dec. 22, 2011 (JP) ..... 2011-281284

(51) Int. Cl.
*B41J 2/19* (2006.01)
*B41J 2/14* (2006.01)

(52) U.S. Cl.
USPC ..... 347/40; 347/68; 347/92

(58) Field of Classification Search
USPC ..... 347/9–12, 40, 42–44, 49, 65–69, 71–72
See application file for complete search history.

(56) References Cited

U.S. PATENT DOCUMENTS 8,287,106 B2 * 10/2012 Yokouchi et al. ..... 347/85

FOREIGN PATENT DOCUMENTS

| | | | |
|---|---|---|---|
| JP | 61-249760 | A | 11/1986 |
| JP | 2006-95878 | A | 4/2006 |
| JP | 2007-168319 | A | 7/2007 |

* cited by examiner

*Primary Examiner* — Thinh Nguyen
(74) *Attorney, Agent, or Firm* — Fitzpatrick, Cella, Harper & Scinto

(57) ABSTRACT

A liquid ejection head includes a plurality of pressure chambers, respectively communicating with a plurality of ejection orifices for ejecting a liquid, for storing the liquid to be ejected from the plurality of ejection orifices. At least a part of a wall portion forming each of the plurality of pressure chambers is formed of a piezoelectric member, and the plurality of pressure chambers causes the plurality of ejection orifices to eject the liquid by deformation of the piezoelectric member. A plurality of space portions is arranged in parallel to the plurality of pressure chambers at intervals, with some of the plurality of space portions being decompressable. A gas permeable member is provided between the pressure chambers and the decompressable space portions so that a gas inside the pressure chambers is exhausted via the decompressable space portions.

8 Claims, 6 Drawing Sheets

LIQUID EJECTION HEAD

BACKGROUND OF THE INVENTION

1. Field of the Invention

The present invention relates to a liquid ejection head for ejecting liquid such as ink.

2. Description of the Related Art

A liquid ejection head for ejecting liquid such as ink is generally mounted onto a liquid ejection device for recording an image on a recording medium by ejecting the liquid such as ink. As a mechanism for causing the liquid ejection head to eject ink, there is known a mechanism using a pressure chamber which is shrinkable in volume by a piezoelectric element. In this mechanism, the pressure chamber shrinks due to the deformation of the piezoelectric element to which a voltage is applied, and thus the ink inside the pressure chamber is ejected from an ejection orifice formed at one end of the pressure chamber. As a liquid ejection head including such a mechanism, there is known a shear mode liquid ejection head in which one or two inner wall surfaces of the pressure chamber are formed of the piezoelectric element, and shear deformation of the piezoelectric element is caused by voltage application, to thereby shrink the pressure chamber.

Regarding liquid ejection devices for industrial applications, there is a demand for use of high viscosity liquid. In order to eject high viscosity liquid, a large ejection force is required for the liquid ejection head. To satisfy this demand, there has been proposed a liquid ejection head called a Gould type, in which the pressure chamber is formed of a piezoelectric member having a circular or rectangular sectional shape. In the Gould type liquid ejection head, the piezoelectric member is uniformly deformed in the inward and outward directions (radial direction) about the center of the pressure chamber. In this manner, the pressure chamber expands or shrinks. In the Gould type liquid ejection head, the entire wall surface of the pressure chamber deforms, and this deformation contributes to the ink ejection force. Therefore, as compared to the shear mode liquid ejection head in which one or two wall surfaces are formed of the piezoelectric element, a larger liquid ejection force can be obtained.

In order to obtain a higher resolution in the Gould type liquid ejection head, it is necessary to arrange a plurality of ejection orifices in higher density. To meet this necessity, it is necessary to arrange the pressure chambers corresponding to the respective ejection orifices in higher density. Japanese Patent Application Laid-Open No. 2007-168319 discloses a method of manufacturing a Gould type liquid ejection head, which is capable of forming the pressure chambers in high density.

In the manufacturing method disclosed in Japanese Patent Application Laid-Open No. 2007-168319, first, a plurality of grooves all extending in the same direction are formed in each of a plurality of piezoelectric plates. After that, the plurality of piezoelectric plates are laminated so that the grooves are uniformly directed, and are cut in a direction orthogonal to the direction of the grooves. The groove part of the cut piezoelectric plate forms an inner wall surface of the pressure chamber. After that, in order to separate the respective pressure chambers, the piezoelectric member present between the pressure chambers is removed to a certain depth. On an upper side of the piezoelectric plate having the completed pressure chambers, a supply path plate and an ink pool plate are connected, and on a lower side thereof, a printed circuit board and a nozzle plate are connected. In this manner, the liquid ejection head is completed. With this manufacturing method, the pressure chambers can be arranged in a matrix, and hence the pressure chambers can be arranged in high density. Further, with this manufacturing method, because forming a groove in the piezoelectric plate is better in workability than opening a hole in the piezoelectric plate, the pressure chambers can be formed with high accuracy.

On the other hand, in the Gould type liquid ejection head, it is known that air bubbles generated inside the pressure chambers cause such an ejection trouble that the ink cannot be ejected from the ejection orifices, and countermeasures against this ejection trouble are required. Japanese Patent Application Laid-Open No. S61-249760 and Japanese Patent Application Laid-Open No. 2006-95878 each disclose a measure of degassing air bubbles and dissolved oxygen in the ink inside the pressure chamber even during printing in order to prevent accumulation of air bubbles in the ejection orifice (nozzle).

In the liquid ejection head manufactured by the manufacturing method disclosed in Japanese Patent Application Laid-Open No. 2007-168319, the plurality of pressure chambers are arranged while being separated from each other with a space provided therebetween. That is, the wall portions forming the respective pressure chambers are independently formed. Therefore, particularly when the length (height) of the pressure chamber is increased in order to eject high viscosity liquid (in other words, in order to increase the liquid ejection force), the rigidity of the liquid ejection head is lowered. When the rigidity is lowered, the pressure chamber may easily break, which may lead to difficulty in liquid ejection.

Further, the measures disclosed in Japanese Patent Application Laid-Open No. S61-249760 and Japanese Patent Application Laid-Open No. 2006-95878 cannot be effectively applied to the Gould type liquid ejection head in which the plurality of ejection orifices (pressure chambers) are two-dimensionally arranged.

SUMMARY OF THE INVENTION

According to an exemplary embodiment of the present invention, there is provided a liquid ejection head, including: a plurality of pressure chambers respectively communicating with a plurality of ejection orifices for ejecting a liquid, for storing the liquid to be ejected from the plurality of ejection orifices, at least a part of a wall portion forming each of the plurality of pressure chambers being formed of a piezoelectric member, the plurality of pressure chambers causing the plurality of ejection orifices to eject the liquid by deformation of the piezoelectric member; a plurality of space portions arranged in parallel to the plurality of pressure chambers at intervals with respect to the plurality of pressure chambers, some of the plurality of space portions being decompressable, wherein a gas permeable member is provided between the pressure chambers and the decompressable space portions so that a gas inside the pressure chambers is exhausted via the decompressable space portions.

Further features of the present invention will become apparent from the following description of exemplary embodiments with reference to the attached drawings.

DESCRIPTION OF THE EMBODIMENTS

In the following, respective embodiments are described with reference to the drawings.

First Embodiment

Figure 1:
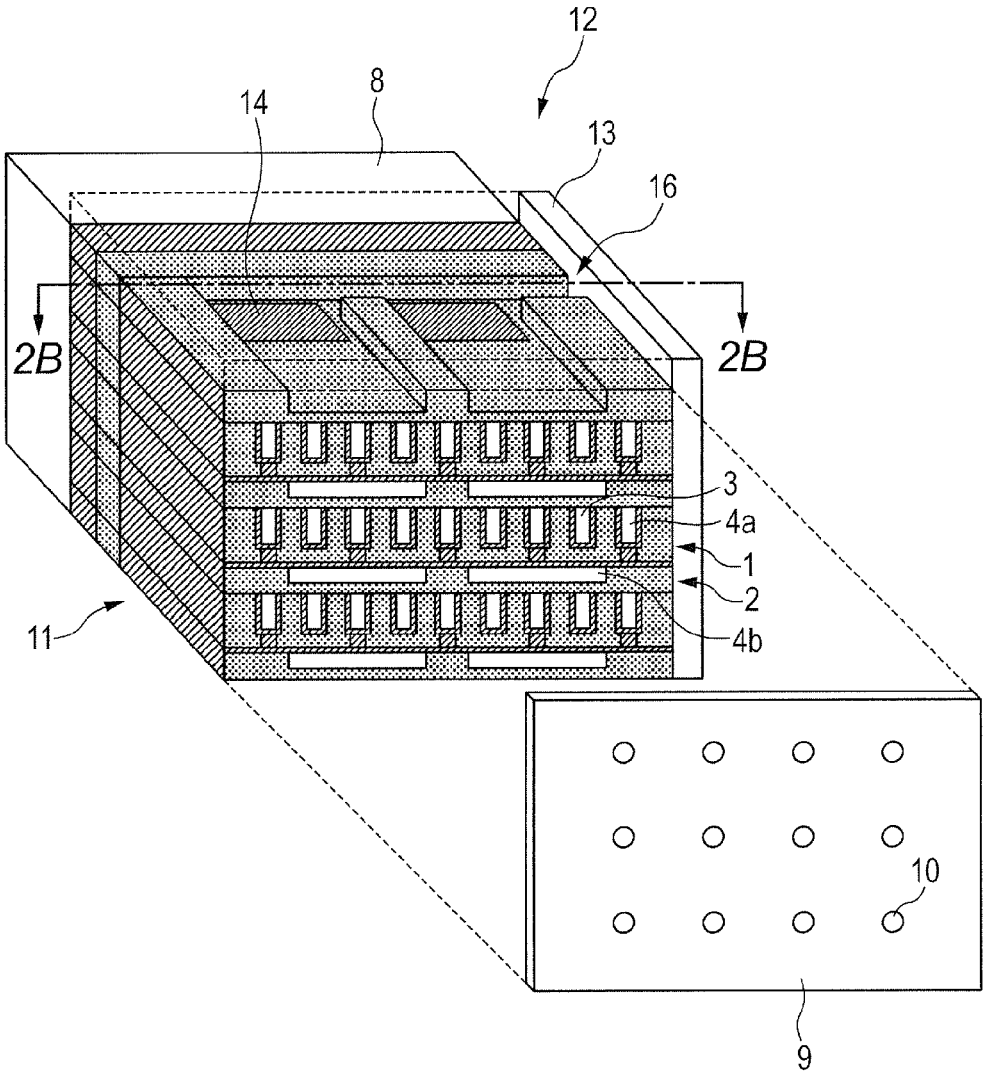
FIG. 1 is a schematic perspective view of a liquid ejection head according to a first embodiment of the present invention.

First, a configuration of a liquid ejection head according to a first embodiment of the present invention is described. FIG. 1 is a schematic perspective view of the liquid ejection head of this embodiment.

Referring to FIG. 1, a liquid ejection head 12 of this embodiment includes a piezoelectric block 11, a nozzle plate 9 bonded to a front surface of the piezoelectric block 11, and an ink pool plate 8 bonded to a back surface of the piezoelectric block 11. Note that, in FIG. 1, for easy understanding of the structure of the piezoelectric block 11, the piezoelectric block 11 and the nozzle plate 9 are illustrated in an exploded manner. The nozzle plate 9 is provided with a plurality of ejection orifices 10 formed of circular through-holes, and those ejection orifices 10 are arranged in a matrix (two-dimensionally) at regular intervals. On a side surface of the piezoelectric block 11, a vacuum exhaust chamber 13 is bonded, which is controlled for vacuum exhausting by a vacuum pump (not shown).

Figure 2A:
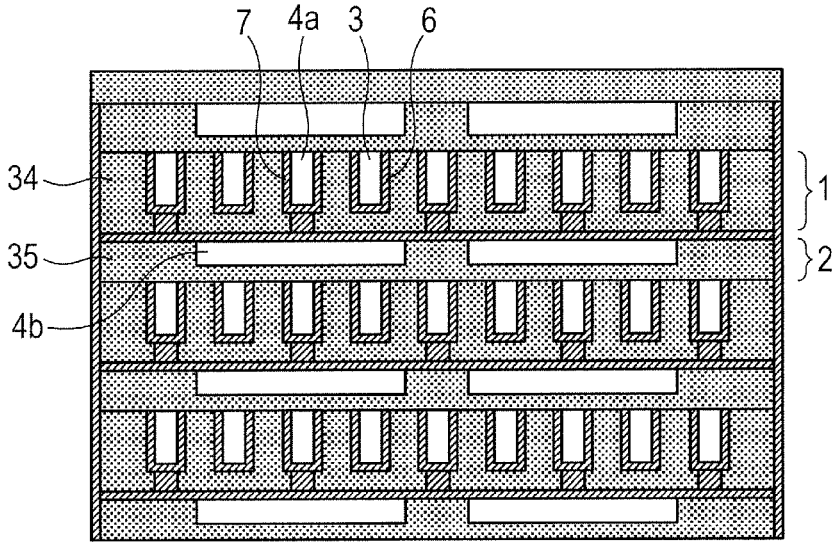
FIGS. 2A and 2B are a schematic front view and a schematic sectional view, respectively, of the liquid ejection head of FIG. 1.
Figure 2B:
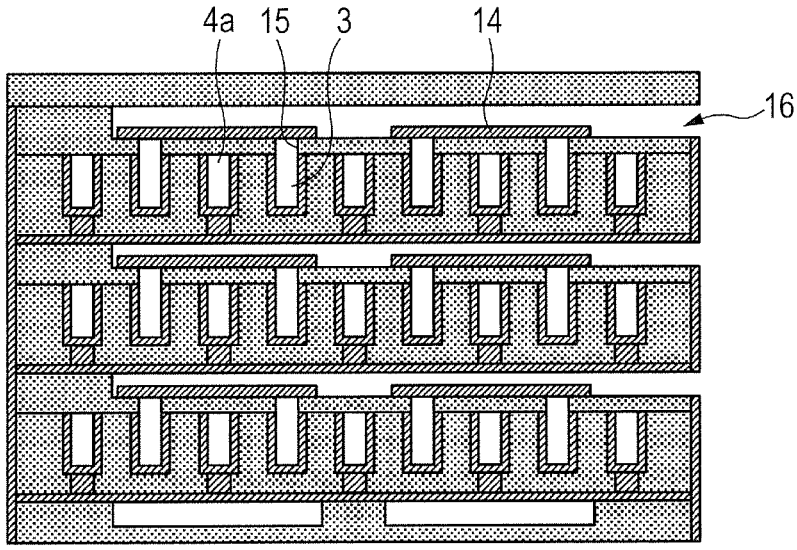

Next, a configuration of the piezoelectric block of this embodiment is described. FIG. 2A is a schematic front view of the piezoelectric block of this embodiment illustrated in FIG. 1, and FIG. 2B is a schematic sectional view of the piezoelectric block taken along the line 2B-2B of FIG. 1.

The piezoelectric block 11 is a layered product including a first plate 1 and a second plate 2, which are alternately laminated with an adhesion layer (not shown) intervening therebetween.

The first plate 1 is formed of a piezoelectric member, and has one surface provided with a plurality of first grooves (pressure chambers) 3, and a plurality of second grooves (first space portions) 4*a* which are arranged alternately with the first grooves 3. On the other hand, the second plate 2 is formed of a ceramic member, and has one surface provided with a plurality of third grooves (second space portions) 4*b*. The first plate 1 and the second plate 2 are laminated so that a surface having the grooves formed therein and a surface not having the grooves formed therein are brought into contact with each other. Accordingly, in the piezoelectric block 11, there are formed a plurality of pressure chambers, and a plurality of space portions (air chambers) arranged around the respective pressure chambers in parallel to the pressure chambers at intervals with respect to the pressure chambers. That is, with the first groove 3 and the second plate 2, a pressure chamber for storing liquid such as ink is formed. Further, with the second groove 4*a* and the second plate 2, a first space portion is formed extending in parallel to the direction in which the pressure chamber 3 extends. Moreover, with the third groove 4*b* and the first plate 1, a similar second space portion is formed. The pressure chamber 3 has one end portion communicating with the ejection orifice 10 of the nozzle plate 9 (see FIG. 1) and the other end portion connected to the ink pool plate 8 (see FIG. 1).

On inner surfaces of the pressure chamber 3 and the first space portion 4*a*, electrodes 6 and 7 are formed, respectively. Voltages are applied between the pressure chamber 3 and the first space portion 4*a* with the respective electrodes 6 and 7 to thereby cause elongation deformation and shrinkage deformation of an inner wall part sandwiched between the pressure chamber 3 and the first space portion 4*a*. In this manner, the liquid stored inside the pressure chamber 3 can be ejected as a liquid droplet from the ejection orifice 10.

In this embodiment, in the first plate 1, the pressure chamber (first groove) 3 and the first space portion (second groove) 4*a* are separated from each other by a wall portion 34 formed of the piezoelectric member. Further, in the second plate 2, the second space portions (third grooves) 4*b* are separated from each other by a wall portion 35 formed of the ceramic member. Those wall portions 34 and 35 are formed so as to be coupled to each other. As a result, in the liquid ejection head 12 of this embodiment, the rigidity around the pressure chamber 3 can be enhanced.

On the other hand, as is understood from FIG. 1, the second space portion (third groove) 4*b* is closed by the nozzle plate 9 on the front surface side of the piezoelectric block 11, but on the rear surface side thereof, as illustrated in FIG. 2B, the second space portion (third groove) 4*b* is connected to a vacuum flow path 16 communicating with the vacuum exhaust chamber 13. Further, as illustrated in FIG. 2B, the second space portion 4*b* is provided with a gas permeable member 14 on the back surface side of the piezoelectric block 11. Further, the second plate 2 is provided with a hole 15 passing through the second plate 2 at a position corresponding to the gas permeable member 14 inside the third groove 4*b*. The gas permeable member 14 is formed of a polyolefin film having an oxygen gas permeability coefficient of $10^{-10}$ $mm^3 \cdot mm/(mm^2 \cdot s \cdot Pa)$, and is bonded to the second plate 2 with an adhesive to close the hole 15. The gas permeable member 14 has a thickness smaller than the depth of the third groove 4*b*, and a size capable of closing the hole 15. Accordingly, a part of the inner wall surface of the pressure chamber 3 is formed of the gas permeable member 14, and thus the gas permeable member 14 and the ink inside the pressure chamber 3 can be brought into direct contact with each other.

With this configuration, in this embodiment, when the vacuum exhaust chamber 13 is vacuum-exhausted by a vacuum pump or the like, the second space portion 4*b* is decompressed via the vacuum flow path 16. Accordingly, via the gas permeable member 14 provided in the second space portion 4*b*, a gas present inside the pressure chamber 3, such as air bubbles generated when the pressure chamber 3 shrinks and deforms, air bubbles and dissolved oxygen in the liquid such as ink, and air entering from the ejection orifices, can be gradually removed. At this time, the gas permeable member 14 having a gas-liquid separating characteristic is used in this embodiment, and thus the ink inside the pressure chamber 3 is not exhausted. Further, in order to prevent the gas in the second space portion 4*b* from entering inside the pressure chamber, it is preferred that the vacuum pump or the like be controlled so that the pressure inside the second space portion 4*b* is always lower than the pressure inside the pressure chamber 3. In this manner, it is possible to remove the air bubbles inside the pressure chamber and to degas ink.

The gas permeable member of this embodiment is formed of a polyolefin film, but the present invention is not limited thereto, and the gas permeable member is only required to be made of a material having gas permeability and formed into a film or sheet shape. Examples of the material for the gas permeable member include silicone, polyethylene, polyethylene terephthalate (PET), polycarbonate, and polypropylene. Further, ceramics having gas permeability can be similarly used. In this case, regarding the gas permeability of each material, the oxygen gas permeability coefficient is preferably $10^{-12}$ $mm^3 \cdot mm/(mm^2 \cdot s \cdot Pa)$ or more, and more preferably $10^{-10}$ $mm^3 \cdot mm/(mm^2 \cdot s \cdot Pa)$ or more. Note that, the upper limit thereof is not particularly limited as long as the ink to be used does not penetrate and leak out.

Second Embodiment

Figure 3:
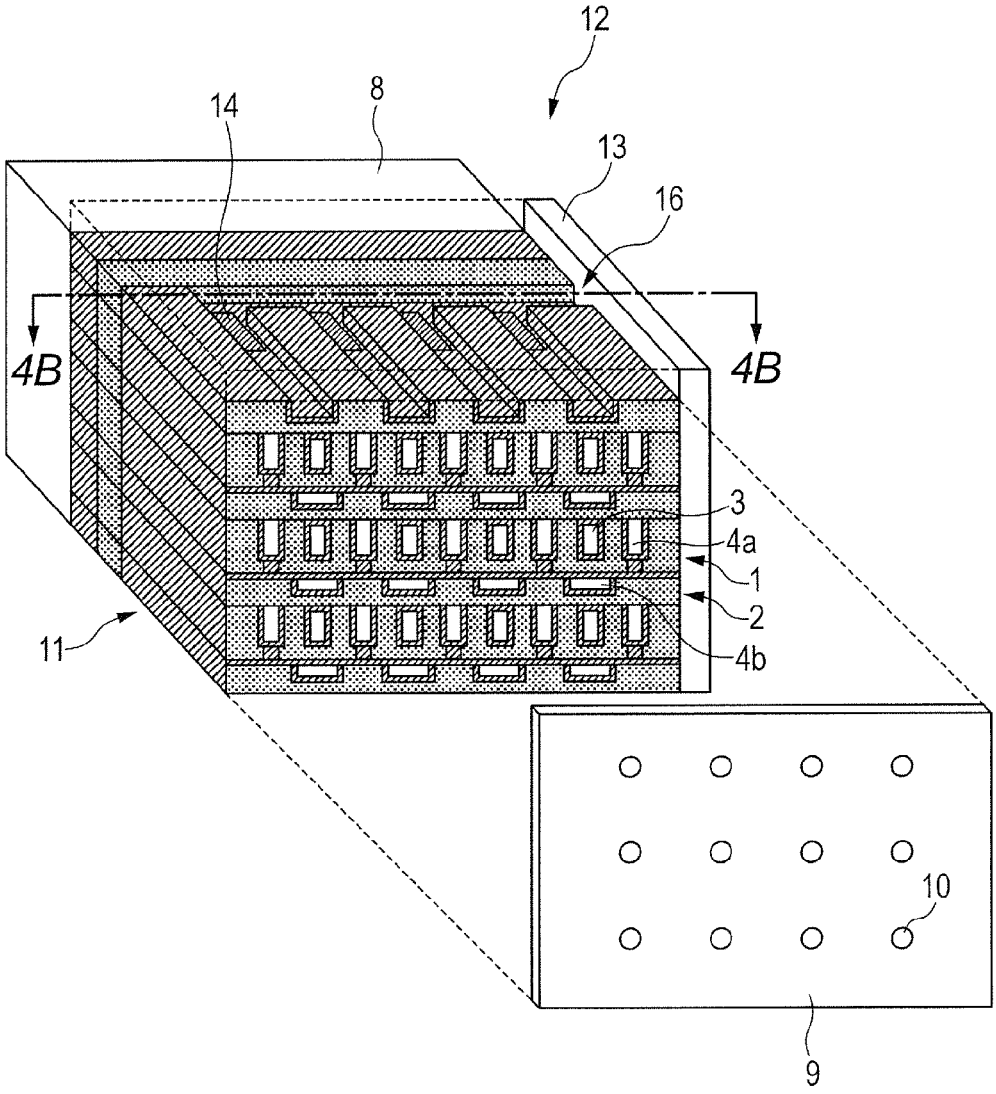
FIG. 3 is a schematic perspective view of a liquid ejection head according to a second embodiment of the present invention.
Figure 4A:
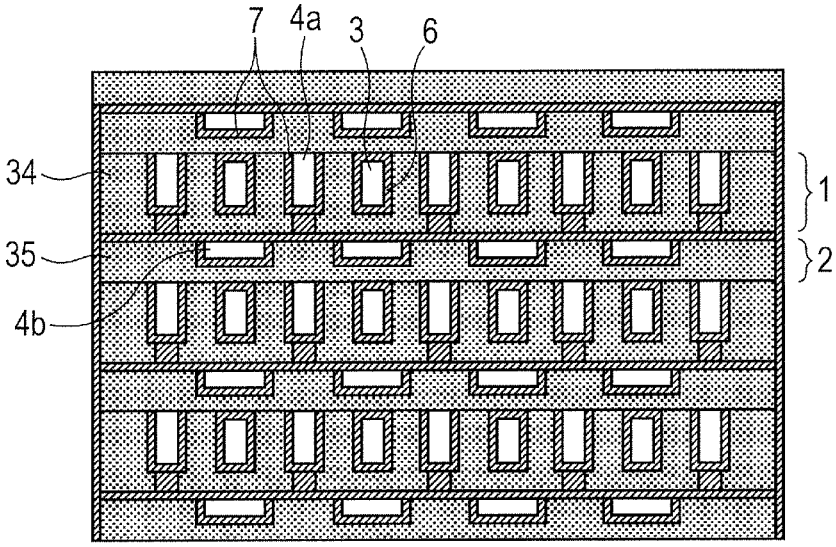
FIGS. 4A and 4B are a schematic front view and a schematic sectional view, respectively, of the liquid ejection head of FIG. 3.
Figure 4B:
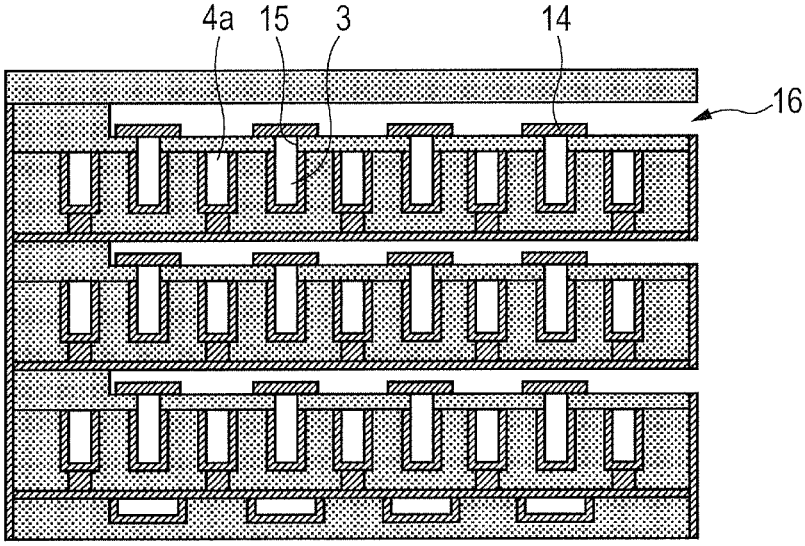

FIG. 3 is a schematic perspective view of a liquid ejection head according to a second embodiment of the present invention. FIG. 4A is a schematic front view of a piezoelectric block of this embodiment illustrated in FIG. 3, and FIG. 4B is a schematic sectional view of the piezoelectric block taken along the line 4B-4B of FIG. 3.

This embodiment is a modified example of the first embodiment, in which the configuration of the piezoelectric block 11, particularly, the configuration of the second plate 2 is changed. Specifically, this embodiment differs from the first embodiment in that the second plate 2 is formed of a piezoelectric member, and the third groove 4*b* is formed so as to be opposed to the first groove 3 forming the pressure chamber. Further, the electrode 7 is formed also in the second plate 2 (specifically, third groove 4*b*). Other configurations are similar to those of the first embodiment except for minor changes such as the shape of the gas permeable member 14.

As described above, in this embodiment, except for the back surface side of the liquid ejection head 12 at which the gas permeable member 14 is provided, a large part of the wall portions 34 and 35 forming the pressure chambers 3 is formed of the piezoelectric member. Further, around the pressure chamber 3 having a rectangular sectional shape, the first and second space portions 4*a* and 4*b* are arranged in respective four side surface directions across the wall portions 34 and 35 formed of the piezoelectric member. Therefore, all of the four wall portions 34 and 35 sandwiched among the first and second space portions 4*a* and 4*b* are shrinkable by the electrodes 6 and 7. As a result, the ink ejection force can be further enhanced.

Third Embodiment

Figure 5:
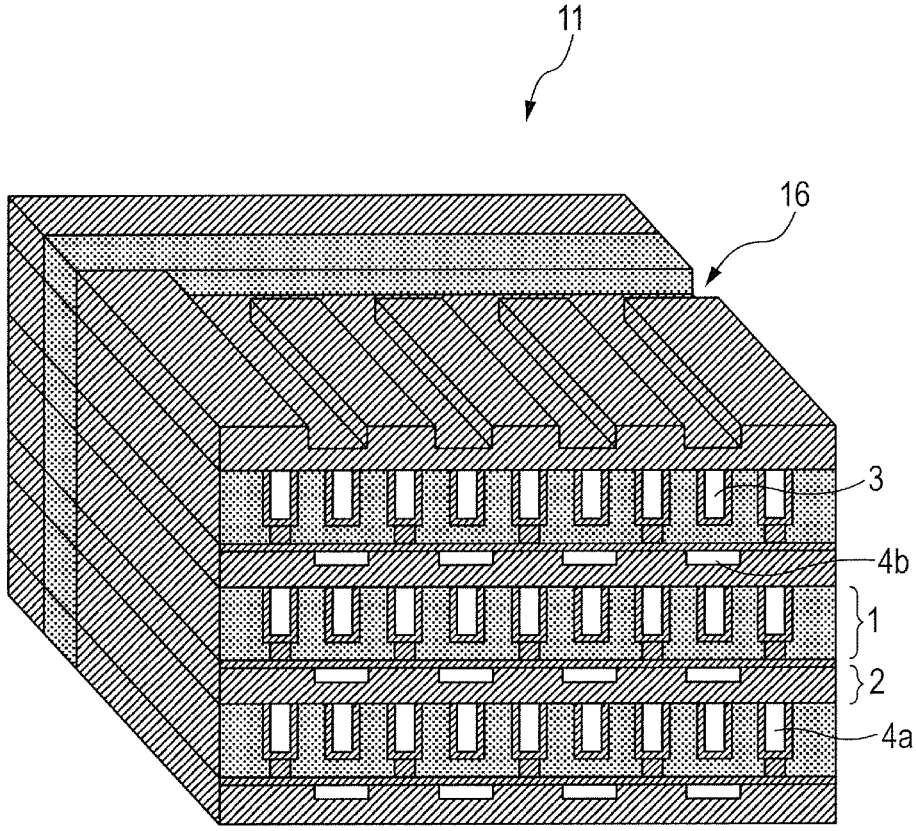
FIG. 5 is a schematic perspective view of a piezoelectric block of a liquid ejection head according to a third embodiment of the present invention.

FIG. 5 is a schematic perspective view of a piezoelectric block in a liquid ejection head according to a third embodiment of the present invention.

This embodiment is another modified example of the first embodiment, in which the configuration of the piezoelectric block 11, particularly, the configuration of the second plate 2 is changed. Specifically, this embodiment differs from the first embodiment in that the second plate 2 is formed of a ceramics member having gas permeability, and the third groove 4*b* is formed so as to be opposed to the first groove 3 forming the pressure chamber as in the second embodiment. Further, in the second plate 2 of this embodiment, the hole 15 provided in the second plate 2 of the first embodiment is not provided. Other configurations are similar to those of the first embodiment.

As described above, in this embodiment, the second plate 2 itself has gas permeability, and hence the degassing of the inside of the pressure chamber 3 can be performed with the entire second plate 2. Therefore, air bubbles and dissolved oxygen near the ejection orifices and inside the ink can be removed very efficiently, and ejection stability can be improved. Further, a process of bonding, with an adhesive, the gas permeable member 14 to the second plate 2 according to the hole 15, which is necessary when the liquid ejection head 12 of the first embodiment is manufactured, is unnecessary. Thus, the structure and the manufacturing process are simplified, which makes it possible to enhance the yield. Also in this embodiment, the vacuum pump or the like is controlled so that the pressure inside the second space portion 4*b* is always lower than the pressure inside the pressure chamber 3, and thus the gas is prevented from entering inside the pressure chamber.

Fourth Embodiment

Figure 6A:
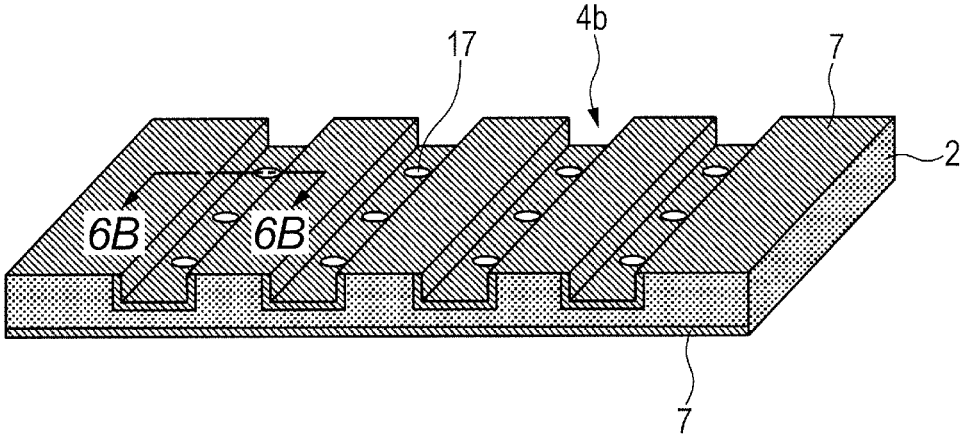
FIGS. 6A and 6B are a schematic perspective view and a schematic sectional view, respectively, of a second plate of the liquid ejection head of FIG. 5.
Figure 6B:
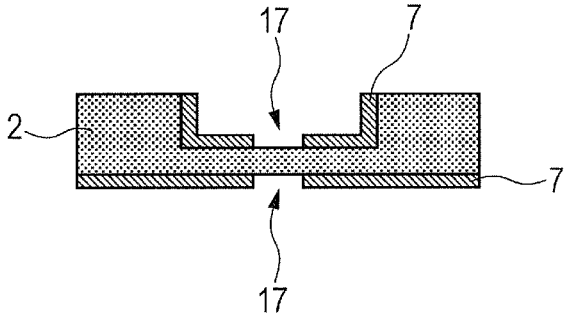

FIG. 6A is a schematic perspective view of a second plate in a liquid ejection head according to a fourth embodiment of the present invention, and FIG. 6B is a schematic sectional view taken along the line 6B-6B of FIG. 6A.

This embodiment is still another modified example of the first embodiment, in which the configuration of the piezoelectric block 11, particularly, the configuration of the second plate 2 is changed. Specifically, the second plate 2 is made of a sintered lead zirconate titanate (PZT) having gas permeability. In other words, the second plate 2 of this embodiment is made of a material having both of a piezoelectric characteristic and gas permeability. Further, the third groove 4*b* is formed in the second plate 2 in a configuration similar to that of the second and third embodiments.

Further, the electrode 7 is formed on both surfaces of the second plate 2. The gas permeability is deteriorated in a part provided with the electrode 7, and hence, in the electrode 7 on both surfaces of the plate an electrode non-forming portion 17 for sufficiently permeating a gas is provided at an overlapping position as viewed from the laminating direction of the plate. The electrode non-forming portion 17 is provided at a position corresponding to the pressure chamber (first groove) 3 of the first plate 1. Therefore, on one surface of the second plate 2, the electrode non-forming portion 17 is provided inside the third groove 4*b*.

As described above, in this embodiment, with the second plate 2 having a piezoelectric characteristic and gas permeability, both of the effects of the second embodiment and the third embodiment can be obtained. That is, a large part of the inner wall forming the pressure chamber 3 becomes shrinkable, and hence the ink ejection force can be further enhanced. In addition, degassing of the inside of the pressure chamber 3 is possible via the electrode non-forming portions 17 of the second plate 2. Therefore, air bubbles and dissolved oxygen near the ejection orifices and inside the ink can be removed very efficiently, and ejection stability can be improved.

The electrode non-forming portions formed on both surfaces of the second plate are only required to be located so as to form a mutually overlapping portion, and the shape and the number of the electrode non-forming portions may be changed as appropriate depending on a degassing characteristic and an ejection characteristic thereof. For example, the electrode non-forming portion is formed into a circular shape in the illustrated embodiment, but as long as the electrode is not disconnected, the electrode non-forming portion may be formed into a rectangular or stripe shape, and it is also not necessary to form the electrode non-forming portions on both surfaces into the same shape. Further, the size of the overlapping region of the electrode non-forming portion on both surfaces of the plate is preferably designed by preliminarily evaluating the gas permeability of the gas-permeable PZT to be used.

Note that, in the liquid ejection head of the present invention, specifications such as the configuration of the ejection orifice (number of ejection orifices, pitch, density, and shape), the groove shape (width, depth, length, and the like), and extraction of the electrode are not limited to those in the above-mentioned embodiments, and may be changed as appropriate depending on the applications.

In the above-mentioned embodiments, in a usage condition of the liquid ejection head, the gas permeable member 14 is provided between the pressure chamber 3 and the space portion (air chamber) located above the pressure chamber 3. In this manner, the gas can be exhausted effectively. However, the present invention is not limited to this configuration, and the gas permeable member 14 may be provided between the pressure chamber 3 and each of the space portions formed on the upper and lower sides of the pressure chamber 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-281284, filed Dec. 22, 2011, which is hereby incorporated by reference herein in its entirety.

What is claimed is:

1. A liquid ejection head, comprising:

a plurality of pressure chambers respectively communicating with a plurality of ejection orifices for ejecting a liquid, the plurality of pressure chambers storing the liquid to be ejected from the plurality of ejection orifices, at least a part of a wall portion forming each of the plurality of pressure chambers being formed of a piezoelectric member, the plurality of pressure chambers causing the plurality of ejection orifices to eject the liquid by deformation of the piezoelectric member;

a plurality of space portions arranged in parallel to the plurality of pressure chambers at intervals with respect to the plurality of pressure chambers, some of the plurality of space portions being decompressable;

a first plate having one surface provided with a plurality of first grooves and a plurality of second grooves arranged alternately with the plurality of first grooves, the first plate being formed of the piezoelectric member; and a second plate having one surface provided with a plurality of third grooves, wherein a gas permeable member is provided between the pressure chambers and the decompressable space portions so that a gas inside the pressure chambers is exhausted via the decompressable space portions, and wherein the first plate and the second plate are alternately laminated so that the first grooves and the other surface of the second plate form the pressure chambers, and the third grooves and the other surface of the first plate form the decompressable space portions.

2. A liquid ejection head according to claim 1, wherein the second plate is provided with a hole passing through the second plate in the third grooves, and wherein the gas permeable member is provided inside the third grooves so as to close the hole.

3. A liquid ejection head according to claim 2, wherein the second plate is formed of a ceramic member.

4. A liquid ejection head according to claim 2, wherein the second plate is formed of a piezoelectric member.

5. A liquid ejection head according to claim 1, wherein the second plate is formed of a ceramic member having gas permeability.

6. A liquid ejection head according to claim 1, wherein the second plate is formed of a piezoelectric member having gas permeability.

7. A liquid ejection head according to claim 6, wherein on each of both surfaces of the second plate an electrode is formed, and wherein the electrode is provided with an electrode non-forming portion at an overlapping position as viewed from a laminating direction of the plate.

8. A liquid ejection head, comprising:

an ejection orifice for ejecting liquid;

a pressure chamber communicating with the ejection orifice, at least a part of an inner wall of the pressure chamber being formed of a piezoelectric member; and an air chamber formed parallel to the pressure chamber, wherein a space between the pressure chamber and the air chamber is formed of a gas permeable member, wherein a pressure inside the air chamber is set lower than a pressure inside the pressure chamber to enable exhausting of a gas inside the pressure chamber to the outside of the pressure chamber, and wherein the gas permeable member comprises a ceramic member.

* * * * *